US010012420B2

(12) United States Patent
Christensen et al.

(10) Patent No.: US 10,012,420 B2
(45) Date of Patent: Jul. 3, 2018

(54) WEATHER-VANING AIR-COOLED HEAT EXCHANGERS

(71) Applicants: Global LNG Services AS, Oslo (NO); Tor Christensen, Sandefjord (NO); Pål Leo Eckbo, Hanover, NH (US)

(72) Inventors: Tor Christensen, Sandefjord (NO); Pål Leo Eckbo, Hanover, NH (US)

(73) Assignees: Tor Christensen, Sandefjord (NO); Pål Leo Eckbo, Hanover, NH (US); Global LNG Services AS, Oslo (NO)

( * ) Notice: Subject to any disclaimer, the term of this patent is extended or adjusted under 35 U.S.C. 154(b) by 0 days.

(21) Appl. No.: 15/125,330

(22) PCT Filed: Mar. 12, 2015

(86) PCT No.: PCT/EP2015/055188

§ 371 (c)(1),
(2) Date: Sep. 12, 2016

(87) PCT Pub. No.: WO2015/140044

PCT Pub. Date: Sep. 24, 2015

(65) Prior Publication Data

US 2017/0074558 A1 Mar. 16, 2017

(30) Foreign Application Priority Data

Mar. 17, 2014 (NO) ..... 20140339

(51) Int. Cl.
*F25B 39/00* (2006.01)
*F28B 1/06* (2006.01)
(Continued)

(52) U.S. Cl.
CPC ..... *F25B 39/00* (2013.01); *F25J 1/0022* (2013.01); *F25J 1/0262* (2013.01); *F28B 1/06* (2013.01);
(Continued)

(58) Field of Classification Search
CPC .. F25B 39/00; F25B 1/06; F25B 39/04; F28B 1/06; F25J 1/0022; F25J 1/0262
See application file for complete search history.

(56) References Cited

U.S. PATENT DOCUMENTS 3,289,742 A 12/1966 Niemann
3,814,177 A 6/1974 Harris et al.
(Continued)

FOREIGN PATENT DOCUMENTS

GB 903397 A 8/1962
NO 328852 B1 5/2010
(Continued)

OTHER PUBLICATIONS

Mellado Ramirez, J., "International Search Report," prepared for PCT/EP2015/055188, dated Jun. 22, 2015, four pages.

*Primary Examiner* — Brian King
(74) *Attorney, Agent, or Firm* — Winstead PC

(57) ABSTRACT

An air-cooler assembly comprising a plurality of air-coolers (1), wherein the air-coolers (1) are arranged on a duct (15), the duct having the shape of a straight prism having a polygonal cross section, and wherein the duct has one air inlet (14) for taking in cooling air to be distributed to all air-coolers (1), is described. A floater (10) for LNG production and a method for LNG production using the air-cooler assembly is also described.

10 Claims, 9 Drawing Sheets

(51) Int. Cl.

| | |
|---|---|
| ***F28D 3/02*** | (2006.01) |
| ***F28D 1/02*** | (2006.01) |
| ***F25J 1/00*** | (2006.01) |
| ***F25J 1/02*** | (2006.01) |
| *F25B 39/04* | (2006.01) |

(52) U.S. Cl.
CPC ..... *F28D 1/024* (2013.01); *F28D 3/02* (2013.01); *F25B 39/04* (2013.01); *F25J 2270/902* (2013.01); *F25J 2290/72* (2013.01)

(56) References Cited

U.S. PATENT DOCUMENTS 6,606,872 B1 8/2003 Smith
8,308,517 B1 * 11/2012 Shivers, III ..... B63B 21/50 114/230.14
2008/0042445 A1 * 2/2008 Stephens ..... E02D 27/42 290/55
2009/0115080 A1 * 5/2009 Dorin ..... F28B 1/06 261/159
2010/0083682 A1 * 4/2010 Koehler ..... F24F 11/0001 62/262
2010/0192626 A1 * 8/2010 Chantant ..... F25J 1/0022 62/606
2010/0218537 A1 * 9/2010 Schulze ..... F28B 1/06 62/314
2010/0282439 A1 * 11/2010 Summerer ..... F28B 1/06 165/95

FOREIGN PATENT DOCUMENTS

NO 20084875 A 5/2010
WO WO 2007015281 A2 * 2/2007 ..... F28B 1/06
WO WO-2007015281 A2 2/2007
WO WO-2009077225 A1 6/2009
WO WO-2010036121 A2 4/2010
WO WO-2010059059 A1 5/2010
WO WO-2013156623 A1 10/2013

* cited by examiner

WEATHER-VANING AIR-COOLED HEAT EXCHANGERS

TECHNICAL FIELD

The present invention relates to improvements related to air cooled heat exchangers, and more specifically, heat exchangers arranged on floating processing plants. Most specifically, the invention relates to improvements relating to air cooled heat exchangers on LNG processing plants arranged on offshore floaters.

BACKGROUND ART

Natural gas is becoming more important as the world's energy demand increases. Natural gas is readily available, in particular with the new technologies now employed to extract and utilize shale gas. Natural gas is much cleaner burning than oil and coal, and does not have the hazard or waste deposition problems associated with nuclear power. The post-combustion emission of greenhouse gases from natural gas is lower than for oil, and only about one third of such emissions from coal.

There is substantial international trade in natural gas, and its price varies significantly in different parts of the world. A large fraction of this trade is in the form of liquefied natural gas (LNG). LNG is produced using two major processing steps. The first step is gas pre-treatment to remove components that can solidify when cooled to cryogenic temperatures, mainly sour components and water. Trace elements, mainly mercury that can form amalgams—in particular with aluminium process components—are also removed from the gas.

Heavy hydrocarbon fractions or Natural Gas Liquids (NGL) may be removed from the gas in the first or second of the two LNG processing steps. The second processing step is mainly liquefaction of the purified gas, composed mainly of methane. This methane, with small amounts of heavier components, is liquid at atmospheric pressure and about −163° C. After liquefaction, the LNG is shipped to the destination and re-gasified.

Processing of natural gas to produce LNG has traditionally been done at large land-based facilities, which include the two steps of pre-treatment and liquefaction at the same location. Recent developments in technology and markets have enabled construction of LNG plants on floating structures, a development that has inspired movement of a substantial portion of LNG processing facilities offshore to Floating Liquefied Natural Gas facilities (FLNG).

Floating LNG production units are also known. WO2010036121 describes a method and system for handling gas, where an liquefaction unit is arranged onboard a LNG carrier for liquefaction of natural gas to be transported in tanks onboard the carrier. Arranging the LNG liquefaction unit onboard the carrier allows for transporting natural gas as LNG from terminals lacking LNG liquefaction possibilities. The LNG liquefaction unit described therein is a standard LNG unit where a cooling unit for cooling nitrogen as cooling medium for the liquefaction is cooled by water coolers.

WO2010059059 describes a device for floating production of LNG, comprising a LNG carrier comprising at least one LNG tank, where projecting hull structures are fixed to the ship hull and are used for arranging the LNG liquefaction unit onboard. Nothing is mentioned therein about the LNG liquefaction unit as such. WO2013156623 relates to a LNG plant comprising a first and a second converted LNG carrier, connected to form a catamaran, and where at least one LNG tank has been removed to create a space for the LNG liquefaction unit. Nothing is mentioned about the LNG liquefaction unit as such.

The FLNGs are typically designed to be located at a distance from a coast and are connected to natural gas supplies by pipelines. The FLNGs typically are also designed to serve as buffer LNG storage and as terminals for loading of LNG tankers that are used for transport of the LNG to the markets.

The recent development towards FLNGs has made offshore natural gas resources more available to the market, and has resulted in a reduction of capital cost for establishing a LNG plant. Other key drivers for offshore liquefaction include reduction of onshore environmental impacts; reduction of land use issues for equipment and infrastructure; and reduced likelihood of opposition from local communities. An entire FLNG plant can be built in a shipyard, which is efficient and improves quality control, cost control and reduces construction time. FLNG's are also mobile and can be transferred to alternative locations if required.

Numerous studies of FLNG technologies have been carried out over the last couple of decades. Currently, several projects are underway worldwide. To date, actual construction has started for three units: the Shell Prelude project, the Exmar/Pacific Rubicales barge project, and the Petronas FLNG 1 project.

In these and other projects, both gas pre-processing and liquefaction will typically be located on the deck of the FLNG. Space below deck is used for LNG storage and marine-specific equipment. The area available on an FLNG deck is generally less than 20% of the area used for similar facilities onshore. Among other design constraints, this reduced process layout space presents safety issues, including proximity to living quarters and limited space for safety barriers. Significantly, it also limits the size of the processing plants and the possibilities to utilize economies of scale.

Accordingly, in addition to safety issues, the liquefaction process involves environmental issues. The liquefaction process generates large amounts of heat, which must be transferred to the environment. With current designs, large amounts of seawater are needed for cooling purposes onboard the FLNG, water that is subsequently discharged back to the sea at a higher temperature. This can be harmful to marine life because of mechanical stress in sea water pipes, pumps and fittings, use of toxic chemicals to prevent fouling, and the increased water temperature. In coastal waters, where marine life is abundant, certain jurisdictions do not allow the use of seawater for cooling at all, with others expected to follow.

The alternative to seawater cooling is air-cooling. However, air-cooling requires substantially more space than seawater cooling. This space is proportional to the cooling duty and to the Logarithmic Mean Temperature Difference (LMTD) between the air and the process fluid to be cooled. The footprint of a well-designed air cooling system, typically with an LMTD of 30° C., might be in the order of 1000 m2 per 100 MW cooling duty. This is a challenge, in particular when available space is less than 20% of the space used on-shore for similar plants.

Liquefaction plants are typically either efficient base-load systems, or less efficient but simpler peak-shaving systems. Known refrigerants, such as hydrocarbons or nitrogen, circulate in cooling systems comprising compressors, air-cooled heat exchangers, and LNG exchangers. Depending on the refrigeration system, refrigerants may or may not be condensed in the air coolers before being routed to the LNG exchangers.

In normal situations, it would be desirable or required to cool/condense the refrigerants to about 30° to 40° C. before the refrigerants are routed to the LNG exchangers. However, in temperate areas, design ambient air temperature may be relatively high (such as 32° C. (90° F.)) or higher, and it is anticipated that the approach temperature for the air cooled heat exchangers should be at least 10° C., preferably 15° C. or more.

Engineers skilled in the art will know that this problem can be solved by operating compressor inter-stage coolers at higher temperatures, and compressing the refrigerants, especially any refrigerant which shall condense, to higher pressure than normal. All cooling and condensation therefore takes place at higher temperatures, enabling air-cooling with high LMTD and high air cooler approach temperatures even in temperate areas. Unfortunately, all of this significantly reduces the liquefaction efficiency, increases the energy demand and therefore increases the cooling duty, which partly defeats strategy of increasing the LMTD and accomplishing air-cooling.

Table 1, see below, illustrates this by comparing work and cooling duty for two liquefaction processes with water and air cooling. Liquefaction rate is 400 metric tons per hour, the feed gas is at 60 bara and 25° C., and consists of 98 mole % methane, 1.5 mole % ethane and 0.5 mole % propane.

TABLE 1

Comparison of work and cooling duty for two liquefaction processes

| | Water cooled | | | | Air cooled | | | |
|---|---|---|---|---|---|---|---|---|
| Liquefaction system | Efficiency (kWh/kg) | Compr duty (MW) | Enthalpy change (MW) | Cooling duty (MW) | Efficiency (kWh/kg) | Compr duty (MW) | Enthalpy change (MW) | Cooling duty (MW) |
| Base load | 0.3 | 120 | 92.9 | 212.9 | 0.36 | 144 | 92.9 | 236.9 |
| Peak shaving | 0.5 | 200 | 92.9 | 292.9 | 0.6 | 240 | 92.9 | 332.9 |

As is evident from table 1, the cooling duty for air-cooled systems is substantially higher than the cooling duty for water-cooled systems.

Air-cooling as such is well known technology, widely used on-shore for power plants, buildings and many other purposes. FIG. 1 illustrates an air cooler 1 arranged on a rack 2. Incoming air for cooling is flowing into the air cooler from below as indicated by arrows 3, and outgoing air, and heated, air is released at the top of the cooler as indicated by arrows 4. Heat transfer medium circulation is indicated with lines 5. Air is drawn in from below, using a fan. This air passes over a coil, which contains the process fluid to be cooled. The air exiting from the air cooler is normally warmer than the ambient air, and will tend to rise because of the lower density. However, a part of the outgoing heated air may flow back into the air inlet and thus reduce the cooling efficiency.

Examples on air cooler arrangements for cooling of liquids and gases may be found e.g. in GB 903 397, describing arrangements of air coolers in parallel rows and where fans are disposed below the air cooler units to blow air from below and upwards through the air cooler units to avoid air heated by the air coolers to be recycled back through the air coolers and thereby reduce the cooling efficiency.

On a floater, with different wind directions and large arrays of air coolers, such recirculation may be likely, and would be detrimental to the performance of an air cooling system. On shore, this problem is partially solved by spreading the air coolers over a large area, and by providing a high air velocity out of the coolers.

Air coolers are also susceptible to fouling or deposition of contaminants on heat exchanging surfaces such as pipes or finned pipes containing the heat transfer medium. On floaters, such contaminants might be salt, smoke or oil mists. This reduces the heat transfer efficiency. In many situations, such fouling is predicted in advance, and the coolers are oversized accordingly. With the limited space on a floater, such oversizing may not be practical. It is known that gas turbines in coastal or offshore areas have similar problems. In this case, the solution has been to provide inlet air filters.

An additional challenge is determination of the design air temperature. In many areas, the annual average air temperature is much lower than the peak summer temperature. Furthermore, the peak summer temperature may occur only a few days per year. It might be highly desirable to size the air coolers based on an average temperature instead of the peak temperature, since this can significantly reduce the number of air coolers.

However, on warm days, this means that the cooling capacity may be severely reduced. In some cases, this problem is solved by using a design air temperature, which is lower than the peak annual temperature, and using a water spray at the air cooler inlet on very warm days. This reduces the air temperature to acceptable levels, because the air wet bulb temperature is usually lower than the dry bulb temperature.

The most important factor determining the economics of an FLNG is the LNG production rate. Higher production rate requires proportionally more cooling and increases the air cooler footprint correspondingly.

All of this shows that it is highly desirable to have as much air cooling capacity as possible, in particular on FLNGs where the space is limited.

A novel adaptation of FLNG, which increases the available space on a floater, is the Coastal Liquefaction, Storage and Offloading (CLSO) facility. The CLSO adaptation addresses FLNG space limitations, safety, environmental impact and the all-important processing capacity. The first processing step, gas pre-processing, is mainly performed on shore, on separate terminals or on dedicated floating systems, instead of occupying valuable space on the FLNG. Pre-processed gas is then piped to one or more floating CLSO's, which now have much more deck space available. Extra deck space on the CLSO, freed up by removing pre-processing, can be used for additional safety features. The extra deck space also opens the possibility of using air-cooling instead of seawater cooling, solving the seawater intake and associated environmental issue. However, it would be far better to use this space for extra production capacity, without falling back on seawater cooling, if possible. Furthermore, possibilities exist for greater liquefaction capacity and the resulting economic advantages.

A large CLSO might e.g. have a length of 350 m and width of 60 m, corresponding to existing hull dimensions for existing, successful vessel designs. The deck space is therefore about 20,000 m2. Desired production might be in the order of 1,000 metric tons LNG per hour for this size CLSO. According to Table 1, for an air-cooled base load system, this would require at least 600 MW of cooling. With air coolers requiring about 1,000 m2 per 100 MW cooling, this will require 6,000 m2 deck area or about one third of the CLSO deck.

Given those requirements, air coolers placed on deck introduce certain design and economic difficulties: it would be very difficult to ensure that all coolers get fresh air and not air that is partly recirculated and therefore too warm for effective operation; for such a large array of coolers, provision of inlet air filters and water spray on hot days would become unwieldy; and, since LNG production capacity depends on the available space air coolers, if placed directly on deck, would significantly reduce the space available for liquefaction capacity.

One design alternative is to locate the air coolers 1 on a cantilever 6 arranged at one side of the hull 7 as shown in FIG. 2. For a floater of the size mentioned above, the cantilever has to be about 17 m wide in the full length of the floater, e.g. about 350 m, to provide an area of 6,000 $m^2$. In addition to this, areas for air cooler access ways may be required for maintenance. This is not very practical. In addition, the air coolers would be exposed to salty seawater mist. The need to provide filters and fresh water spray onto the coolers on hot days would further complicate this design approach.

Alternative configurations are shown in FIGS. 3 and 4. These configurations raise other issues such as height, hot air blown into the deck of the floater or non-symmetrical momentum created by the airflow from the coolers. Air recirculation, which is detrimental to the air cooler efficiency, would be a problem in all of these cases.

An object of the present invention is therefor to provide improvements in air cooler efficiency for such floaters as described above.

SUMMARY OF INVENTION

According to a first aspect, the present invention relates to an air-cooler assembly comprising a plurality of air-coolers, wherein the air-coolers are arranged on a duct, the duct having the shape of a straight prism having a polygonal cross section, and wherein the duct has one air inlet for taking in cooling air to be distributed to all air-coolers. Arrangement of air coolers at a duct having one air inlet and where the air introduced through said air inlet is distributed to all air-coolers arranged on the duct, makes it possible to control the intake of air and to ascertain that air heated by cooling the air coolers is not recycled back to the air coolers to reduce the cooling efficiency thereof. Additionally, controlled intake of air for cooling allows for removal of seawater, solids etc. from the cooling air to avoid deposition of salt and other solids onto the heat exchanger surfaces, which may result in reduced efficiency thereof. Accordingly, maintenance for removal of solid matter from the heat exchange surfaces may be substantially reduced.

According to one embodiment, the length axis of the duct is substantially horizontally arranged. The duct is preferably arranged substantially horizontal to control the height of the construction. For use onboard floaters, as described herein, high constructions has to be held at a minimum to avoid instability of the floating structure and to keep the windsail effect low.

According to one embodiment, the air inlet is provided with one or more fan(s). Fans in the air inlet are preferred to ascertain that air is introduced into the duct via the air inlet, only. The fan(s) creates a certain overpressure inside the duct compared to the surroundings to avoid uncontrolled ingress of air through other openings in the duct. Additionally, the fans are important to overcome the pressure drop over any equipment for removal of water and/or solids from the incoming air.

The air inlet may be provided with separators for separating liquid and particles from the incoming air. The content of liquids, such as salty water, and solids in the incoming air has to be kept low to avoid salt and other solids to deposit or settle onto the heat exchange surfaces of the air coolers. The separators are one means for said reduction.

According to one embodiment, the air inlet is provided with one or more spray nozzle(s) for humidifying and cooling the incoming air. Controlled introduction of water in the form of spray may be preferred to increase the humidity of the air, and thus the heat capacity thereof to increase the efficiency of the air cooler.

A filter for removal of water droplets may be arranged downstream of the sprays nozzle(s).

According to a second aspect, the present invention relates to a floater for LNG production comprising a plurality of air-coolers for obtaining the cooling capacity needed, wherein the air-coolers are arranged on a duct, the duct having the shape of a straight prism having a polygonal cross section, and wherein the duct has one air inlet for taking in cooling air to be distributed to all air-coolers.

According to one embodiment, the floater is anchored via a swivel tether or a turret, where the floater is allowed to weather-vane to keep the air inlet upwind. By keeping the floater on station using an anchored turret column, where a bearing arrangement enables the floater to weather vane by moving around the turret column, and a fluid transfer system comprising a swivel with associated equipment, the floater and the duct air inlet may be kept substantially upwind. Keeping the floater and thus the air inlet upwind ascertains that the coolest air available is introduced into the air intake, and that the air that is heated in the air coolers and released into the surroundings, is not returned into the duct and finally the air coolers, as this would result in hotter air in the duct and thus lower cooling efficiency.

According to one embodiment, the floater is an elongated ship-shaped floater having a bow end and an aft end, where the turret and swivel are arranged at the bow end of the floater and where the duct is arranged substantially parallel with the length axis of the floater.

According to a third aspect, the present invention relates to a method for producing LNG from natural gas onboard a floater, comprising the steps of:

bringing pre-treated natural gas onboard a floater, cooling the natural gas to produce LNG by repeated cycles comprising compression, cooling and expansion of a refrigerant and heat exchange between the cold refrigerant and the natural gas to cool the natural gas, wherein the cooling of the refrigerant during the production of LNG is performed by means of air coolers arranged on one or more ducts being arranged so that all air coolers are receiving air from the inside of said one or more duct(s), and where the air used in the air coolers is released to the surroundings through the air cooler(s).

According to one embodiment, the duct(s) is (are) oriented so that the air inlet thereof is upwind relative to the air coolers arranged on the duct.

DETAILED DESCRIPTION OF THE INVENTION

Figure 1:
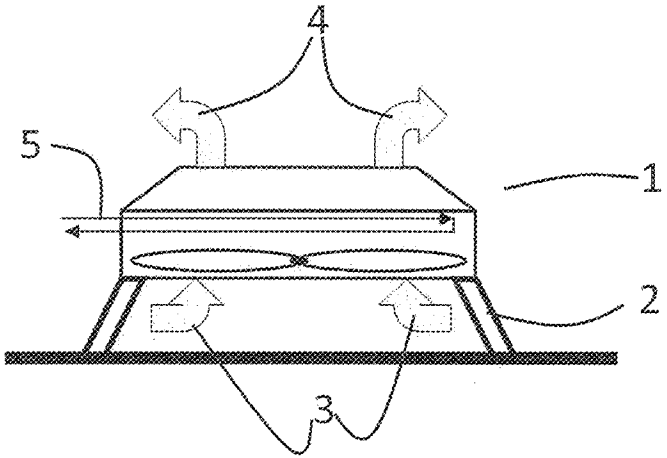
FIG. 1 shows a traditional arrangement of an air cooler on a rack, and the air flow in and out of the air cooler.
Figure 2:
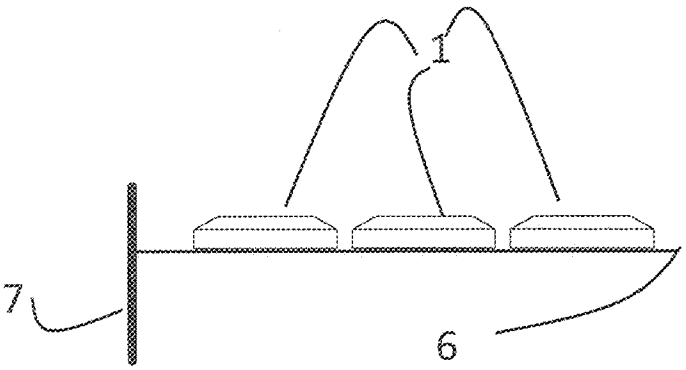
FIG. 2 illustrates air coolers arranged at a horizontally arranged cantilever.
Figure 3:
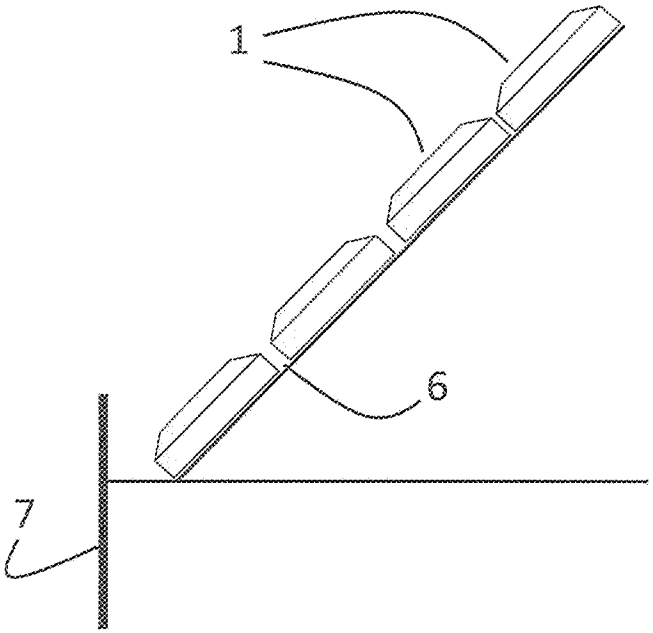
FIG. 3 illustrates air coolers arranged at a tilted cantilever.
Figure 4:
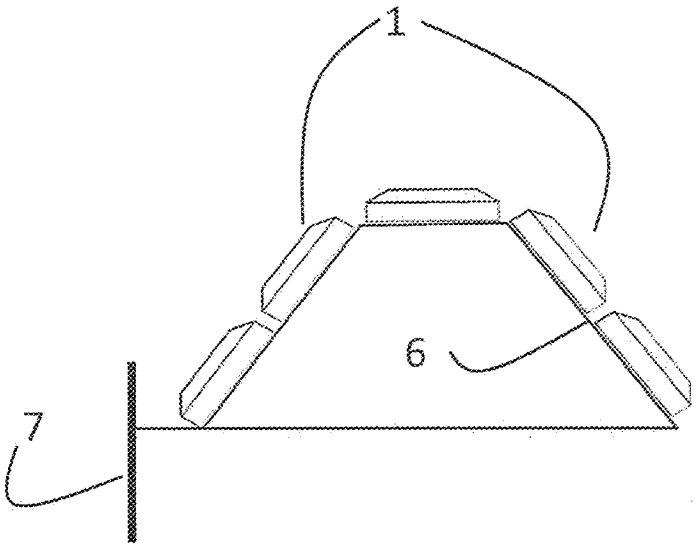
FIG. 4 illustrates an alternative cantilever having both horizontal and tilted areas for arrangement of coolers.
Figure 5:
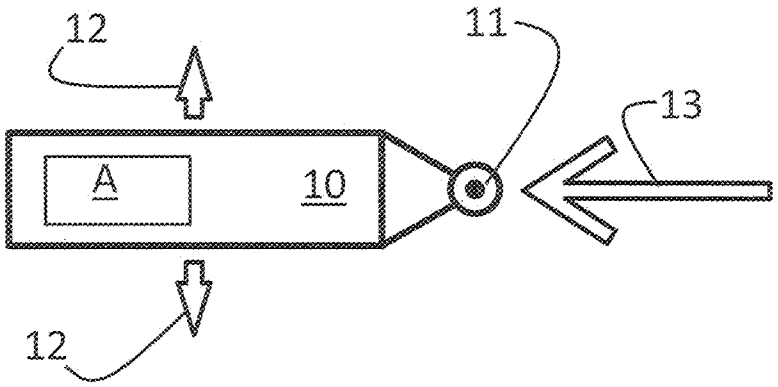
FIG. 5 illustrates the movement of a turret anchored vessel or floater as response to wind.
Figure 6:
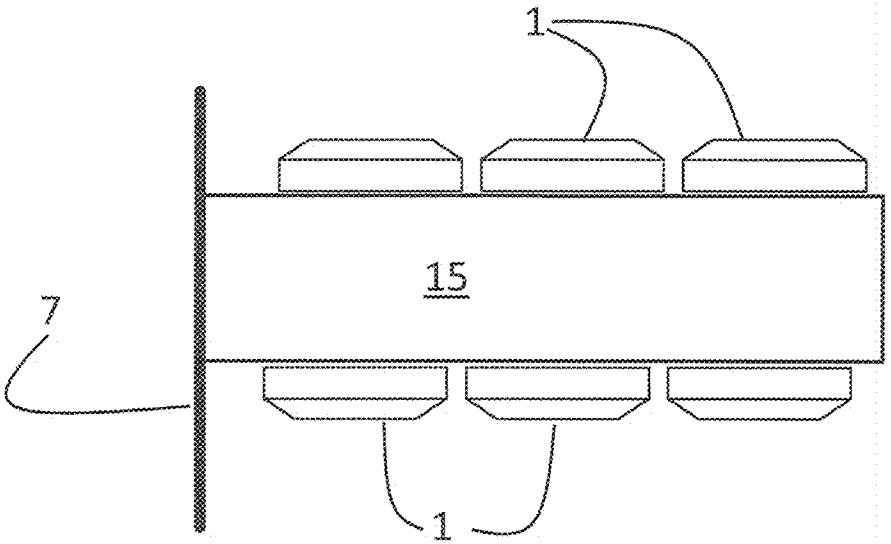
FIG. 6 is a cross section through a cooler channel according to the present invention.
Figure 8:
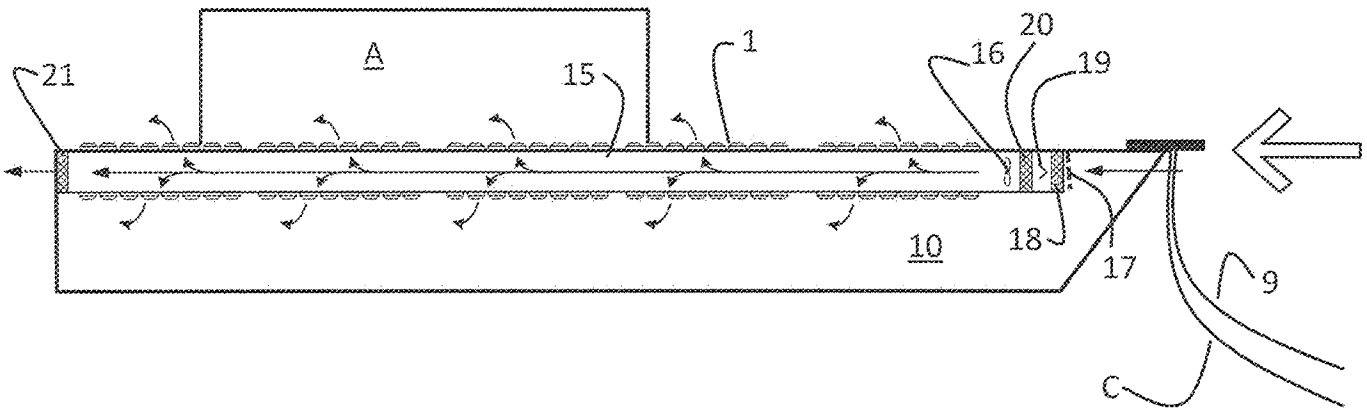
FIG. 8 is a side view of cooler channel according to the present invention arranged on a floater.
Figure 9:
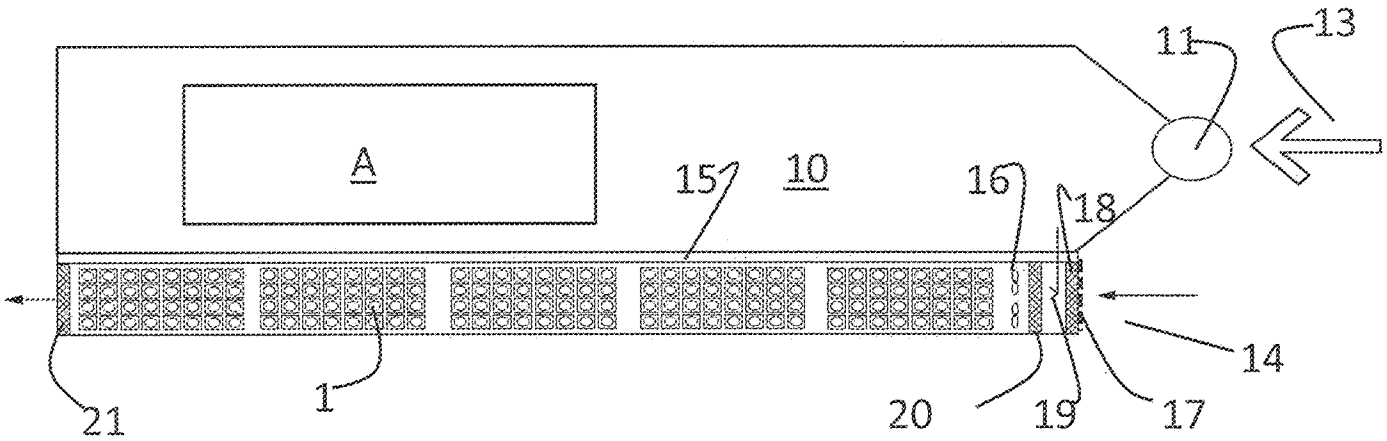
FIG. 9 is a bird's eye's view of the cooler and floater as shown in FIG. 8.

LNG plants with associated power production will according to the present invention be located on offshore floaters 10 as illustrated in FIGS. 5, 8, 9. The floater is preferably ship-shaped, i.e. formed as an elongated floating "hull", having a bow-shaped forward end and an aft end. The floater 10 is anchored with one or more anchors which are connected to the floater via a turret, anchored by anchor lines C, and associated bearing and swivel system 11 arranged at or close to the bow of the floater. The skilled person will understand that the term "turret" is used to encompass a turret anchoring and loading/unloading system as is widely used in offshore operations, and any other corresponding solutions that can be used for anchoring a vessel allowing the vessel to rotate with the wind and that comprises connections for piping.

Preferably, the natural gas to be cooled and liquefied is pre-treated by one or more of the following processes:

- gas sweetening, i.e. removal of unwanted acid gases from the natural gas,
- dehydration, i.e. removal of water that may otherwise cause formation of hydrates from the gas,
- Hg removal,
- full or partial NGL processing, i.e. separation of the NGL from the gas and/or receiving NGL separated from the gas on the floaters, and fractionation of the NGL into saleable products, typically ethane, propane, butane and a heavier C5+ fraction, and
- compression of the pre-processed natural gas.

The pre-treatment is performed to reduce the processing onboard the floater to liquefaction only, and to avoid separation of NGL that has to be treated separately.

The pre-treated natural gas to be liquefied is supplied via a gas pipe 9 (see FIG. 8) connected to the turret and swivel 11. The floater 10 is free to rotate by the power of the wind about the turret, so that the floater 10 will "weathervane" as indicated by arrows 12 by means of the action of the wind indicated by 13, to keep the bow substantially up against the wind. Not shown thrusters may be arranged at the floater to adjust the orientation of the floater in the case that the wind is too weak to turn the floater into the preferred orientation. The skilled person will also understand that it may be preferred to position the floater so that the bow is not pointing directly up against the wind, but deviates at an angle of e.g. 5 to 20 degrees from the upwind direction, to allow any gas leakages at the deck to blow out of the deck partly sideways.

The LNG liquefied onboard the floater may be stored in buffer tanks in the floater hull and loaded for export onto not illustrated LNG shuttle tankers made fast to the floater to load LNG, and thereafter transporting the LNG to its destination. Normally, such LNG shuttle tankers will make fast to one side of the floater.

Liquefaction will be accomplished using known technologies, either efficient base load liquefaction plants or simpler peak shaving liquefaction technologies. Liquefaction processes are powered by compressors with inter- and after-coolers, where compressors and coolers reduce the enthalpy of refrigerant(s).

The low-enthalpy refrigerant(s) is (are) introduced into LNG exchanger(s) where the pre-treated natural gas is pre-cooled, liquefied and sub-cooled. The resulting LNG is stable at atmospheric pressure and about −163° C. The refrigerant, having higher enthalpy when exiting the LNG exchanger(s), is returned to the compressor suction side.

The air coolers are according to the present invention arranged on one or more air cooler duct(s) 15 being arranged along one side of the floater. The air cooler duct 15 may have any convenient cross section. The air cooler duct 15 has preferably a straight polygonal prism shape, and has a substantially horizontal length axis. The illustrated embodiments of FIGS. 8 and 9, have rectangular or rhombic cross sections, but the skilled person will understand that different polygonal cross sections are applicable. The length of the air cooler duct may correspond to the total length of the floater, but may be somewhat shorter, such as 2 to 20% shorter than the floater. The air duct has an air intake opening 14 in the end thereof close to the front end, or bow, of the floater, and an air outlet 21 opening at the end closest to the aft of the floater 10.

Due to the weather-vaning of the floater, the air intake opening 14 will be upwind, and the air outlet is downwind, ascertaining that the air released from the air coolers is not returned into the air coolers. This optimizes the air cooling effect.

A weather hood 17 is preferably arranged in front of the air intake opening 14 to stop or substantially reduce ingress of seawater into the air duct 15. The skilled person will understand that the weather hood 17 conveniently comprises a metal grid or screen arranged so that air is allowed to flow through, but which stops a substantial part of water following the airflow. Downstream of the weather hood 17, separators 18 are arranged for stopping water solids, drops and droplets above a given size. Preferably, droplets and solids being larger 50 microns in diameter are stopped. More preferred solids and droplets having a size larger than 30, such as 20 microns, are stopped by the weather hood and separators. The separators 18 may be any kind of packing known by the skilled person to be applicable for said task.

Spray nozzles 19 for humidifying of the incoming air may be provided downstream of the separators 18. The water used for humidifying is fresh water or desalinated water to avoid salt depositions inside the duct 15. A filter 20 is preferably arranged downstream of the spray nozzles to remove excess droplets from the water spray. By spraying water into the airflow, the air may be cooled from dry bulb to wet bulb temperature, which may reduce the temperature by, for example, about 5° C. The water used for spraying should be distilled water, transported to the floater on a supply vessel.

One or more fan(s) 16 is (are) arranged in the air intake 14 for the duct 15 to ascertain sufficient airflow into the duct 15. The illustrated fan(s) 16 is (are) arranged downstream of the filter 20. The fan(s) 16 might alternatively be arranged between the separators 18 and the filter 20.

Air coolers 1 are arranged at the side walls of the air cooler duct 15 so that air for cooling of the coolers 1 is withdrawn from the inside of the air cooler duct 15, and released into the surroundings. This arrangement, together with the weather-vaning of the floater, ascertains that the hot air released from the air coolers is not recycled into the same or a neighbouring air cooler.

Louvers 21 are preferably arranged at the aft end of the duct 15, to ascertain a slight overpressure inside the duct compared to the surrounding pressure. By keeping an overpressure inside the duct of e.g. 0.002 bar, air ingress into the duct, other than from the air intake 14, may be avoided. The louvers 21, or any other convenient control means, may be adjusted to maintain such a slight overpressure.

In order to use air coolers at all, the liquefaction plants must be adapted such that refrigerants in the compressor inter- and after-cooler systems are warmer than normal and therefore able to transfer waste heat into hot ambient air. Persons skilled in the art know how to do this, but doing so will always increase the specific compressor duty and hence the cooling duty.

The increased compressor duty and the increased cooling duty carry very large cost in terms of reduced liquefaction capacity, in particular on a CLSO where the available power and space are limited. Compared to building a second floater, it would be much more cost efficient if the compressor duty could be reduced, even when air coolers are used, and increase the liquefaction capacity accordingly.

The compressor duty will be reduced if the air cooling capacity is increased by increasing the number of air coolers, if fouling of the air cooler heat transfer surfaces is reduced, and if hot air recirculation over the air coolers is minimized in all weather conditions. In addition, the air cooler capacity is increased if the air temperature is reduced, for example on hot days, by water spray, which reduces the temperature from the dry bulb temperature to the lower wet bulb temperature.

This cooler arrangement increases the space available for air coolers substantially, compared to the normal use where air is discharged in the upwards direction only. This cooler arrangement also ascertains that the hot air is not redirected into the air coolers, as the cooling air is introduced into the duct at the windward end. By directing the flow or released hot air upwards and downward, no transversally directed forces that my rotate the floater is created by the air coolers. The skilled person will understand that the duct 15 may be arranged outside of the deck of the floater as described, or may be arranged above the deck. Additionally, more than one duct may be arranged at one floater, such as two or more air ducts, according to the need thereof.

Figure 7:
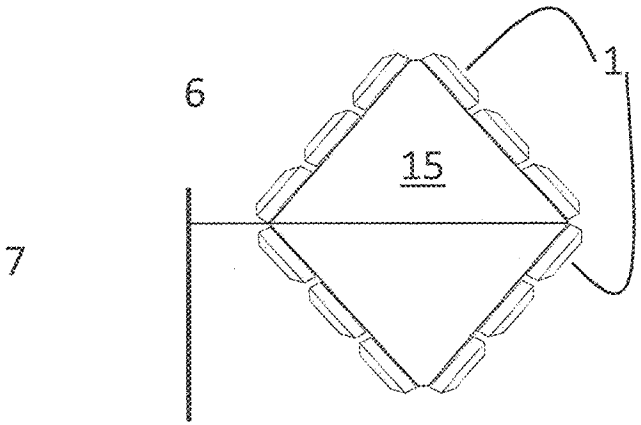
FIG. 7 is a cross section of an alternative cooler channel according to present invention.

Dependent on the configuration of the duct 15, air coolers 1 may be arranged at two or more of the surfaces of the air duct 15. FIG. 7 illustrates an air duct having a rhombic cross section, and where lengths sections through the opposite corners of the cross section are vertical and horizontal, respectively. The air coolers 1 are arranged at all four side walls of the duct 15 as illustrated in FIG. 7, and the air coolers are symmetrically arranged about horizontal lengths section through the top and bottom corners of the duct, so that transversally directed forces resulting from the action of the fans in the air coolers, counteract each other, and resulting in no transversal forces on the floater.

The resulting prevailing wind direction relative to the floater ascertains that the hot air leaving the air coolers is blow away from the air intake of the duct 15. As mentioned above, the turret and swivel arrangement 11 on the floater 10 allows the floater to weathervane or turn such that the bow heads substantially into the wind, such as directly into the wind or deviating e.g. 2 to 20 degrees from heading direction into the wind. Preferably, the duct and air coolers are arranged at the leeward or downwind side of the floater if the floater has an orientation deviating from pointing directly into the wind. It may be preferred to arrange the turret or to construct the floater so that the floater does not weather vane with the bow directly into the wind. A prevailing incoming wind direction deviating e.g. from 5 to 15 degrees form heading directly into the wind, may be preferable to ascertain that any gas due to gas leaks on the floater is blown partly sideways and away from the air coolers, not onto the floater deck. An automatic orientation by weather-vaning deviating from direct headwind as described here may be obtained by arranging the turret to one side of the length axis of the floater, and/or by using the superstructure onboard the floater as a windsail turning the floater to one side.

The skilled person will understand the details and variations of the anchored turret, the bearing arrangement allowing the floater to weather-vane, and the swivel enabling gas transfer from the fixed pipeline direction into the variable floater direction, all of which is shown as item 11 in FIG. 5.

Air cooler duty may be described by the following equation:

$$Q=UA*\text{LMTD}$$

where

Q=Duty, W

UA=air cooler size, W/° C.

LMTD=logarithmic mean temperature difference (between air and process fluid in the air coolers)

As an example, air coolers with and UA of 1.4e+6 W/° C. would occupy a footprint area of 300 $m^2$. If the LMTD is 30° C., the total cooling capacity would be 42 MW. If the LMTD for these coolers is reduced to 15° C., the duty or capacity to cool process fluids is reduced to 21 MW. However, in this case, the process fluid or refrigerant temperature would be much closer to the air temperature, i.e. colder. In most cases, this will improve the process efficiency significantly. The duty of the air coolers has been reduced by reducing the LMTD, but can be increased according to this invention by using the duct with free space both upwards and downwards, doubling the number of air coolers. Then, the duty is brought back up to 42 MW, while maintaining the LMTD of 15° C. and the correspondingly colder refrigerant temperatures.

A second example shows the operating conditions for the duct for a specific air cooling duty. Consider a floater 350 m long, with a 300 m rectangular duct 15 m wide and 12 m high. The total area for air coolers, assuming ample space for access and maintenance, is 3000 $m^2$ for air coolers facing upwards, and the same for air coolers facing downwards. The total air cooler area is 6,000 $m^2$. This gives a total UA of 1.4 e+6×(6000/300) W/° C., or 28 MW/° C. Furthermore, the LMTD is 22° C., which gives a total cooling duty of 28×22 MW or 616 MW.

For a base load liquefaction system with capacity 400 metric tons LNG per hour, the cooling duty is 236.9 MW according to Table 1. With a cooling capability of 616 MW, the production capacity is 400×(616/236.9) metric tons per hour, or about 1040 metric tons LNG per hour.

Table 2 gives an overview of the duct and air cooler operating conditions for this example. The mass flow of air is 12,300 kg/s and the air velocity at the duct inlet is 57 m/s. This velocity is gradually reduced to near zero at the aft duct outlet because air is consumed by the air coolers. The total pressure drop in the duct inlet and the duct itself is about 0.006 bar. An 8.5 MW fan is required to overcome this pressure drop.

TABLE 2

Example of air duct and air cooler operating conditions

| Variable | Unit | Value |
|---|---|---|
| Total cooling duty | MW | 616 |
| Air heat capacity | kJ/kg-K | 1.0 |
| Air temperature | ° C. | 20 |
| Air temperature rise in air coolers | ° C. | 50 |
| Air mass flow | kg/s | 12300 |
| Air volume flow | m3/s | 10200 |
| Air velocity in duct inlet | m/s | 57 |
| Air velocity in duct outlet | m/s | ~0 |
| Air duct inlet filter pressure drop | bar | 0.005 |
| Air duct pressure drop | bar | 0.001 |
| Total air duct pressure drop | bar | 0.006 |
| Fan duty | MW | 8.5 |

A very effective air-duct inlet filter has been assumed, similar to filters used in gas turbines in coastal areas. A less efficient filter or an enlarged air intake will reduce the pressure drop and reduce the fan power requirement such as to 2 or 3 MW. The airflow is large, but can be reduced by increasing the air temperature rise in the air coolers. This will reduce the air velocity in the duct, and further reduce the fan duty.

A person skilled in the art will know that increasing the air temperature rise in the air coolers may be done by reducing the number of stages in a train of compressors and intercoolers in the cooling system, such as from three to two stages, while maintaining the total pressure increase. This will significantly increase the discharge temperature from the remaining compressor stage(s), feeding the air coolers with much warmer process fluid, which therefore can heat the air to a higher temperature. As an illustration, instead of heating the air from 20° to 80° C., it may be heated from 20° to 140° C., reducing the airflow by about 50%. Compressors which can work with fewer stages and higher pressure increase over each stage may for example employ supersonic shock wave technologies instead of conventional turbo-compressor technology A third example shows how compressor duty is reduced when increased space for air cooling is available, such as in a duct where air from air coolers can be discharged vertically downwards in addition to vertically upwards. The compressor could be an integral part of a natural gas liquefaction process or some general gas compression process.

Consider a compressor system comprising a first stage compressor, an air-cooled intercooler, a second stage compressor and an air cooled after-cooler. Methane is compressed from 2 to 6 bara in the first stage, and from 6 to 11.5 bara in the second stage. The methane flow rate is 1.0 e+6 kg/h. Pressure drop in the air coolers is minimal and therefore ignored in this example.

Compressor stage 1 has a duty of 69.8 MW in all cases. Air cooler 1 has an UA of 1.4 e+6 W/° C. when the available footprint is 300 m2. When the footprint increases, the UA and air flow increase proportionally. The result of this is that the methane is cooled more, to a temperature that is closer to the inlet air temperature. In case 1, the methane temperature is 60° C. after the intercooler. In case 2, which has 50% more air cooling capacity, the methane temperature is 40° C. out of the intercooler. In case 3, with two times the cooling area available relative to case 1, the methane temperature has decreased to 29° C. downstream of the intercooler.

The colder methane, which flows to compressor stage 2, has a lower volume, and therefore the duty of compressor 2 decreases from 44.3 to 40.2 MW, or by about 10%, when the air cooler capacity is increased by a factor of two.

The compressor after-cooler capacity is also increased from case 1 to case 3. It gets a lower methane inlet temperature, 126.6° C. in case 1, 104.4° C. in case 2, and 92.0° C. in case 3 with the largest intercooler. The result of this, plus increased after-cooler capacity, is much reduced after-cooler outlet temperature, starting with 60.4° C. in case 1, 35.7° C. in case 2 and 25.9° C. in case 3. If the compressed and cooled methane is used in a refrigeration system, the colder gas from case 3 will be far more efficient.

TABLE 3

The second stage compressor duty is reduced in cases 2 and 3, relative to case 1.

| Process | Source of data | Variable | Unit | Case 1 1.0 * air cooler area | Case 2 1.5 * air cooler area | Case 3 2.0 * air cooler area |
|---|---|---|---|---|---|---|
| Compr 1 | CH4 | Flow | kg/h | 1.0e+6 | 1.0e+6 | 1.0e+6 |
| | | P(in) | bara | 2.0 | 2.0 | 2.0 |
| | | P(out) | bara | 6.0 | 6.0 | 6.0 |
| | | T(in) | ° C. | 20.0 | 20.0 | 20.0 |
| | | T(out) | ° C. | 126.7 | 126.7 | 126.7 |
| | | Duty | MW | 69.8 | 69.8 | 69.8 |
| Air cooler 1 | CH4 | Flow | kg/h | 1.0e+6 | 1.0e+6 | 1.0e+6 |
| | | T(in) | ° C. | 126.7 | 126.7 | 126.7 |
| | | T(out) | ° C. | 60.0 | 40.0 | 29.0 |
| | Air | Flow | kg/h | 2.0e+6 | 3.0e+6 | 4.0e6 |
| | | T(in) | ° C. | 20.0 | 20.0 | 20.0 |
| | | T(out) | ° C. | 100.8 | 89.3 | 78.3 |
| | Air | Q | MW | 45.4 | 58.4 | 65.4 |
| | cooler | LMDT | ° C. | 32.5 | 27.8 | 23.4 |
| | | UA | W/° C. | 1.40e+6 | 2.1e+6 | 2.8e+6 |
| | | Footprint | m2 | 300 | 450 | 600 |
| Compr 2 | CH4 | Flow | kg/h | 1.0e+6 | 1.0e+6 | 1.0e+6 |
| | | P(in) | bara | 6.0 | 6.0 | 6.0 |

TABLE 3-continued

The second stage compressor duty is reduced in cases 2 and 3, relative to case 1.

| Process | Source of data | Variable | Unit | Case 1 1.0 * air cooler area | Case 2 1.5 * air cooler area | Case 3 2.0 * air cooler area |
|---|---|---|---|---|---|---|
| | | P(out) | bara | 11.5 | 11.5 | 11.5 |
| | | T(in) | ° C. | 60.0 | 40.0 | 29.0 |
| | | T(out) | ° C. | 126.6 | 104.4 | 92.0 |
| | | Duty | MW | 44.3 | 41.6 | 40.2 |
| Air cooler 2 | CH4 | Flow | kg/h | 1.0e+6 | 1.0e+6 | 1.0e+6 |
| | | T(in) | ° C. | 126.6 | 104.4 | 92.0 |
| | | T(out) | ° C. | 60.4 | 35.7 | 25.9 |
| | Air | Flow | kg/h | 2.0e+6 | 3.0e+6 | 4.0e6 |
| | | T(in) | ° C. | 20. | 20.0 | 20.0 |
| | | T(out) | ° C. | 100.9 | 74.7 | 59.1 |
| | Air cooler | Q | MW | 45.5 | 46.0 | 43.8 |
| | | LMDT | ° C. | 32.5 | 21.9 | 15.6 |
| | | UA | W/° C. | 1.40e+6 | 2.1e+6 | 2.8e+6 |
| | | Footprint | m2 | 300 | 450 | 600 |

A fourth example is a compressor after-cooler, cooled by water circulating between the after-cooler and air cooler. This indirect cooling of the compressed gas may simplify the system and improve its safety. This example shows that indirect cooling is more efficient, and the after-cooler becomes much smaller, when the air cooling capacity is increased according to this invention.

Consider a compressor, which compresses 1.0 e+6 kg/h methane from 2 to 6 bara. The after-cooler is a methane/water heat exchanger. Cold water flows into the after-cooler, where it is heated. The hot water is then pumped to an air cooler, which removes the same amount of energy as supplied in the methane/water after-cooler. Results are shown in Table 4.

TABLE 4

Effect of larger air cooler area on an indirect compressor cooling system

| Process | Source of data | Variable | Unit | Case 1 1.0 * air cooler area | Case 2 1.5 * air cooler area | Case 3 2.0 * air cooler area |
|---|---|---|---|---|---|---|
| Compr 1 | CH4 | Flow | kg/h | 1.0e+6 | 1.0e+6 | 1.0e+6 |
| | | P(in) | bara | 2.0 | 2.0 | 2.0 |
| | | P(out) | bara | 6.0 | 6.0 | 6.0 |
| | | T(in) | ° C. | 20.0 | 20.0 | 20.0 |
| | | T(out) | ° C. | 126.7 | 126.7 | 126.7 |
| | | Duty | MW | 69.8 | 69.8 | 69.8 |
| CH4/ water exchanger | CH4 | Flow | kg/h | 1.0e+6 | 1.0e+6 | 1.0e+6 |
| | | T(in) | ° C. | 126.7 | 126.7 | 126.7 |
| | | T(out) | ° C. | 65.0 | 65.0 | 65.0 |
| | Water | Flow | kg/h | 5.0e+5 | 5.0e+5 | 5.0e+5 |
| | | T(in) | ° C. | 53.0 | 31.8 | 24.3 |
| | | T(out) | ° C. | 122.4 | 101.7 | 94.3 |
| | Exchanger | Q | MW | 42.2 | 42.2 | 42.2 |
| | | LMDT | ° C. | 7.5 | 28.9 | 36.4 |
| | | UA | W/° C. | 5.60e+6 | 1.45e+6 | 1.15e+6 |
| Air cooler | Water | Flow | kg/h | 5.0e+5 | 5.0e+5 | 5.0e+5 |
| | | T(in) | ° C. | 122.4 | 101.7 | 94.3 |
| | | T(out) | ° C. | 53.0 | 31.8 | 24.3 |
| | Air | Flow | kg/h | 2.0e+6 | 3.0e+6 | 4.0e+6 |
| | | T(in) | ° C. | 20.0 | 20.0 | 20.0 |
| | | T(out) | ° C. | 95.0 | 70.1 | 57.7 |
| | Air cooler | Q | MW | 42.2 | 42.2 | 42.2 |
| | | LMDT | ° C. | 30.1 | 20.1 | 15.0 |
| | | UA | W/° C. | 1.4e+6 | 2.1e+6 | 2.8e+6 |
| | | Footprint | m2 | 300 | 450 | 600 |

The compressor operation is the same for cases 1, 2 and 3. The cooling of the methane in the after-cooler is also the same, although the advantage with larger air cooler might have been used to cool the methane to a lower temperature.

The advantage with larger air coolers in this example is, as Table 4 shows, to provide colder cooling water to the methane/water heat exchanger. This means that, for the same duty, the LMDT of the water/methane heat exchanger is increased from 7.5° C. in case 1, to 28.9° C. in case 2 and further to 36.4° C. in case 3. The heat exchanger UA, or size, is reduced correspondingly. This saves space and cost in the compressor after-cooler exchanger. The air cooler footprint, made possible according to this invention, increases the airflow and air cooler UA proportionally from case 1 to cases 2 and 3. As a result, the size of process equipment, in this case the water/methane exchanger, is reduced, freeing up valuable space on the floater deck.

A fifth example is a steam cycle, which is used for power supply on many floaters. This example shows that the steam cycle becomes more efficient, and the power output increases, when the air cooling capacity is increased according to this invention. Low-pressure steam from a steam turbine flows to an air cooler where the steam is condensed. The condensate is pumped to a heat source, typically a boiler, where it is vaporized and super-heated. The high-pressure steam drives the steam turbine.

TABLE 5

Steam turbine system efficiency increases when more air coolers are employed

| Process | Source of data | Variable | Unit | Case 1 1.0 * air cooler area | Case 2 1.5 * air cooler area | Case 3 2.0 * air cooler area |
|---|---|---|---|---|---|---|
| Heater (Evaporator, super-heater) | H2O | Flow | kg/h | 31960 | 31343 | 31056 |
| | | P(in) | bara | 25.0 | 25.0 | 25.0 |
| | | P(out) | bara | 20.0 | 20.0 | 20.0 |
| | | T(in) | ° C. | 56.1 | 43.3 | 37.1 |
| | | T(out) | ° C. | 300 | 300 | 300 |
| | | Duty | MW | 25 | 25 | 25 |
| Expander | H2O | Flow | kg/h | 31960 | 31343 | 31056 |
| | | T(in) | ° C. | 300 | 300 | 300 |
| | | T(out) | ° C. | 56.8 | 44.0 | 37.9 |
| | | P(in) | bara | 20 | 20 | 20 |
| | | P(out) | bara | 0.171 | 0.090 | 0.065 |
| | | Power | MW | 6.18 | 6.64 | 6.86 |
| Air cooled condenser | H2O | Flow | kg/h | 31960 | 31343 | 31056 |
| | | T(in) | ° C. | 56.8 | 44.0 | 37.9 |
| | | T(out) | ° C. | 55.8 | 43.0 | 36.9 |
| | Air | Flow | kg/h | 2.0e+6 | 3.0e+6 | 4.0e+6 |
| | | T(in) | ° C. | 20 | 20 | 20 |
| | | T(out) | ° C. | 53.7 | 41.9 | 36.3 |
| | Condenser data | Duty | MW | 18.85 | 18.39 | 18.16 |
| | | LMDT | ° C. | 13.5 | 8.8 | 6.5 |
| | | UA | W/m2 | 1.4e+6 | 2.1e+6 | 2.8e+6 |
| | | Footprint | m2 | 300 | 450 | 600 |
| Pump | H2O | Flow | kg/h | 31960 | 31343 | 31056 |
| | | P(in) | Bare | 0.171 | 0.090 | 0.065 |
| | | P(out) | Bare | 25 | 25 | 25 |
| | | T(in) | ° C. | 55.8 | 43.0 | 36.9 |
| | | T(out) | ° C. | 56.1 | 43.3 | 37.1 |
| | | Duty | MW | 0.03 | 0.03 | 0.03 |

Results are shown in Table 5. Similar to examples three and four, air cooler footprint is increased from 300 $m^2$ to 450 and 600 $m^2$ for cases 1, 2 and 3, respectively.

The heater duty and the pressure and temperature from the boiler are the same in each case. The steam conditions will therefore not affect the system efficiency. For the expander or steam turbine, the outlet pressure decreases when the air cooling capacity is increased from case 1 to cases 2 and 3. As a result, the power output increases from 6.18 to 6.64 and 6.86 MW when the allowable air cooler footprint is increased by 50 and 100%, respectively. This is an 11% increase in the power output. There is no significant effect on the condensate pump, except a small decrease in condensate flow rate for cases 2 and 3.

For a person skilled in the art, and depending on permits and environmental conditions, it would be possible to optimize the system by partial use of sea water for cooling, for example using a submerged pipe in which hot water is introduced, flows and is cooled by conduction of heat to the surrounding sea water, exits and is returned to the process for re-use as coolant, by different distribution of NGL fractionation duties between the terminal and the CLSO, and by using alternative liquefaction processes such as N2 refrigerant for smaller systems. In addition, the floater turret and associated swivel may be located in the bow or on the forward deck; the available space in the cantilever and/or duct, freed up by mounting some air coolers for vertical downward discharge of air, may be used for other equipment; the duct may have rectangular, rhombic or other shape; the air cooling capacity may be extended by mounting some coolers elsewhere on the floater; a distance may be provided from the air duct to the first air coolers to further prevent air recirculation; and the sequence of apparatus in the duct inlet may be modified such as using chillers to cool the air instead of water spray.

The invention claimed is:

1. An air-cooler assembly comprising:

a plurality of air-coolers arranged on a duct;

wherein the duct has the shape of a straight prism having a polygonal cross section and one air inlet, the air inlet being for taking in cooling air to be distributed to all of the plurality of air-coolers;

wherein the plurality of air coolers are arranged at side walls of the duct so that air for cooling the plurality of air coolers is withdrawn from inside of the duct and released into the surroundings;

wherein the duct and the plurality of air-coolers are mounted to a pivotable weather-vaning turret-anchored vessel with a turret that, when acted on by wind, positions the air inlet upwind so that air released from the plurality of air-coolers does not re-enter the air inlet; and wherein the turret is arranged to one side of a central length axis of the pivotable weather-vaning turret-anchored vessel so that the central length axis deviates from heading directly into the wind.

2. The air cooler assembly according to claim 1, wherein the length axis of the duct is substantially horizontally arranged.

3. The air cooler arrangement according to claim 1, wherein the air inlet is provided with at least one fan.

4. The air cooler assembly according to claim 1, wherein the air inlet is provided with separators for separating liquid and particles from the incoming air.

5. The air cooler assembly according to claim 1, wherein the air inlet is provided with at least one spray nozzle for humidifying and cooling the incoming air.

6. The air cooler assembly according to claim 5, wherein a filter for removal of water droplets is arranged downstream of the at least one spray nozzle.

7. The air cooler assembly of claim 1, wherein the central length axis deviates between 5 to 20 degrees from heading directly into the wind.

8. The air cooler assembly of claim 1, wherein the duct and the plurality of air-coolers are mounted along one side of the pivotable weather-vaning turret-anchored vessel.

9. The air cooler assembly of claim 1, wherein the turret is arranged at a bow of the pivotable weather-vaning turret-anchored vessel.

10. The air cooler assembly of claim 1, wherein the turret is arranged close to a bow of the pivotable weather-vaning turret-anchored vessel.

* * * * *